US012421749B2

(12) United States Patent
Reski

(10) Patent No.: US 12,421,749 B2
(45) Date of Patent: Sep. 23, 2025

(54) EXHAUST STACK LATTICE TOWER

(71) Applicant: Great Plains Towers, Inc., West Fargo, ND (US)

(72) Inventor: Kevin Reski, West Fargo, ND (US)

(73) Assignee: Great Plains Tower Products LLC, Fargo, ND (US)

( * ) Notice: Subject to any disclaimer, the term of this patent is extended or adjusted under 35 U.S.C. 154(b) by 223 days.

(21) Appl. No.: 18/344,312

(22) Filed: Jun. 29, 2023

(65) Prior Publication Data

US 2024/0052665 A1 Feb. 15, 2024

Related U.S. Application Data

(63) Continuation-in-part of application No. 18/323,290, filed on May 24, 2023, which is a continuation of application No. 17/818,882, filed on Aug. 10, 2022, now Pat. No. 11,613,902.

(51) Int. Cl.

| | |
|---|---|
| ***E04H 12/10*** | (2006.01) |
| ***E02D 27/42*** | (2006.01) |
| ***E04H 12/08*** | (2006.01) |
| ***E04H 12/18*** | (2006.01) |
| ***E04H 12/22*** | (2006.01) |

(52) U.S. Cl.

CPC ..... *E04H 12/08* (2013.01); *E02D 27/42* (2013.01); *E04H 12/10* (2013.01); *E04H 12/187* (2013.01); *E04H 12/2261* (2013.01)

(58) Field of Classification Search

CPC ..... E04H 12/08; E04H 12/10; E04H 12/187; E04H 12/2261; E04H 12/28; E02D 27/42; F23J 11/00; E04G 23/008; E04G 23/04

USPC ..... 52/633, 636, 634, 635, 648.1, 652.1, 52/653.1, 653.2, 218, 146; 454/47.1

See application file for complete search history.

(56) References Cited

U.S. PATENT DOCUMENTS

| | | | | | |
|---|---|---|---|---|---|
| 795,332 | A * | 7/1905 | Broome | E04H 12/28 | 52/146 |
| 1,858,925 | A * | 5/1932 | Goodrich | E04H 12/2261 | 52/295 |
| 2,804,950 | A * | 9/1957 | Leslie, Jr. | E04H 12/187 | 52/646 |
| 3,233,567 | A * | 2/1966 | Goldfield | F23J 11/00 | 138/111 |
| 3,780,639 | A * | 12/1973 | Wood | E04H 12/28 | 52/222 |
| 3,812,771 | A * | 5/1974 | Yokoyama | E04H 12/28 | 52/651.01 |
| 4,520,600 | A * | 6/1985 | Bordet | E04H 12/28 | 52/83 |
| 6,108,996 | A * | 8/2000 | McGinnis | E04H 12/2292 | 52/651.03 |
| 6,199,345 | B1 * | 3/2001 | Dean | E04G 23/04 | 52/219 |
| 6,513,299 | B1 * | 2/2003 | Damiano | H01Q 1/12 | 52/651.04 |

(Continued)

*Primary Examiner* — Brent W Herring

(74) *Attorney, Agent, or Firm* — Fargo Patent & Business Law; Thomas Kading; Joshua Krank

(57) ABSTRACT

A lattice tower structure includes a first lattice section that comprises a first leg, a second leg, and a third leg forming a triangular shaped first lattice section of the tower, the first, second and third leg each constructed of a solid galvanized steel rod; and an exhaust stack at least partially secured within the first, second and third leg.

14 Claims, 9 Drawing Sheets

(56) References Cited

U.S. PATENT DOCUMENTS

| | | | | |
|---|---|---|---|---|
| 8,578,679 | B1 * | 11/2013 | Petricio Yaksic | E04H 12/28 52/745.18 |
| 9,366,456 | B2 * | 6/2016 | Montresor | E04H 12/34 |
| 9,932,749 | B2 * | 4/2018 | Gauché | F24S 25/70 |
| 11,613,902 | B1 | 3/2023 | Reski | |
| 2016/0168841 | A1 * | 6/2016 | Zhou | E04B 1/1903 52/652.1 |

* cited by examiner

FIG. 6
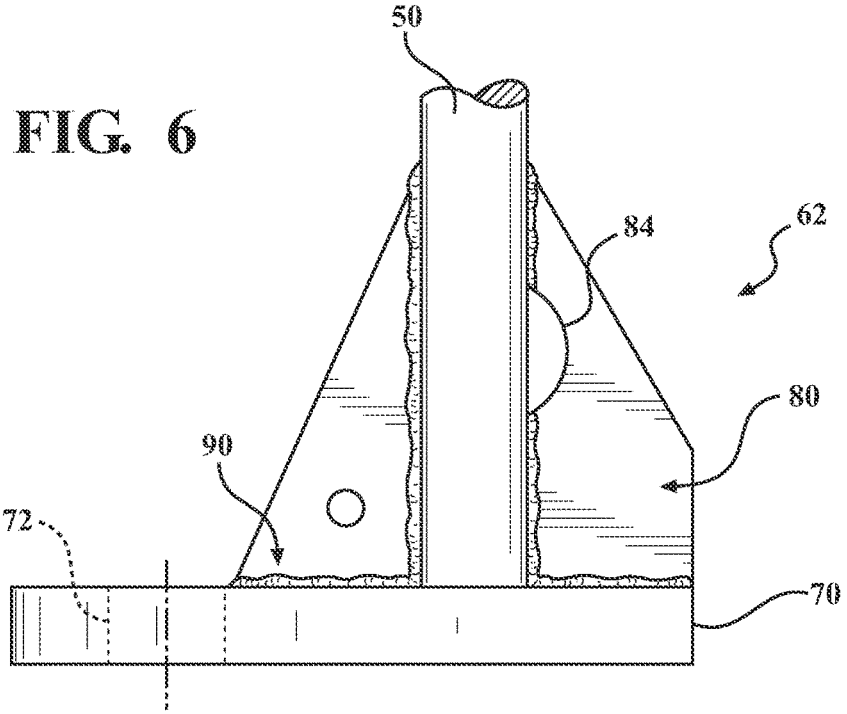
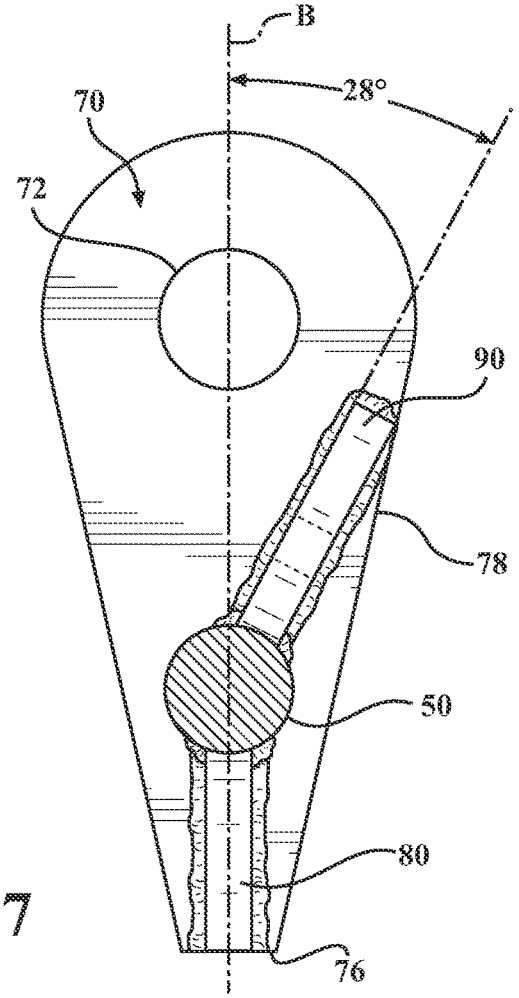
FIG. 7

EXHAUST STACK LATTICE TOWER

CROSS REFERENCE TO RELATED APPLICATIONS

The present disclosure is a continuation-in-part of U.S. patent application Ser. No. 18/323,290 filed May 24, 2023, which is a continuation-in-part of U.S. patent application Ser. No. 17/818,882 filed Aug. 10, 2022, which issued as U.S. Pat. No. 11,613,902 on Mar. 28, 2023.

BACKGROUND

The present disclosure relates to lattice towers, and more particularly to a lattice tower that supports an exhaust stack.

An exhaust stack often extends from machinery. The machinery may at least partially support the exhaust stack as typified in the chemical industry, petroleum industry, flammable gases emission, etc. The exhaust stack often has a height range from 10 m to 100 m.

Should the exhaust stack or machinery require maintenance, the exhaust stack may require a separate support tower.

SUMMARY

A lattice tower structure according to one disclosed non-limiting embodiment of the present disclosure includes a first lattice section that comprises a first leg, a second leg, and a third leg forming a triangular shaped first lattice section of the tower, the first, second and third leg each constructed of a solid galvanized steel rod; and an exhaust stack at least partially within the first, second and third leg.

A further embodiment of any of the foregoing embodiments of the present disclosure includes a multiple of stack supports that extend from each of the first, second and third legs to engage a vertical stack section of the exhaust stack.

A further embodiment of any of the foregoing embodiments of the present disclosure includes that each of the multiple of stack supports comprise an annular portion and an attachment portion, the annular portion mounted around one of the respective legs and the attachment portion attached to the vertical stack section of the exhaust stack, the annular portion welded to the respective leg.

A further embodiment of any of the foregoing embodiments of the present disclosure includes that at least one of the multiple of stack supports is located between each of a first horizontal and a second horizontal between at least two of the first, second and third legs.

A further embodiment of any of the foregoing embodiments of the present disclosure includes a multiple of horizontals between at least two of the first, second and third legs, at least one of the multiple of stack supports located between each pair of the multiple of horizontals.

A further embodiment of any of the foregoing embodiments of the present disclosure includes that at least one of the multiple of stack supports is located between each of a first diagonal and a second diagonal between at least two of the first, second and third legs.

A further embodiment of any of the foregoing embodiments of the present disclosure includes a multiple of diagonals between at least two of the first, second and third legs, at least one of the multiple of stack supports located between each pair of the multiple of diagonals.

A further embodiment of any of the foregoing embodiments of the present disclosure includes a foot welded to each leg of the lattice section, each foot having an aperture; an inner gusset welded to each foot and the respective leg, the inner gusset extends toward an inner edge of the respective foot; and an outer gusset welded to each foot, the outer gusset extends toward the aperture of the respective foot.

A further embodiment of any of the foregoing embodiments of the present disclosure includes that each outer gusset defines an angle with respect to an axis defined between a center of the aperture and a center of the respective leg.

A further embodiment of any of the foregoing embodiments of the present disclosure includes that the outer gusset extends outward toward the aperture.

A further embodiment of any of the foregoing embodiments of the present disclosure includes that the outer gusset defines an angle.

A further embodiment of any of the foregoing embodiments of the present disclosure includes that the outer gusset defines an angle with respect to the axis.

A further embodiment of any of the foregoing embodiments of the present disclosure includes that the angle is 28 degrees.

A further embodiment of any of the foregoing embodiments of the present disclosure includes that the outer gusset extends for a length greater than the inner gusset with respect to the leg.

A further embodiment of any of the foregoing embodiments of the present disclosure includes an annular support formed as a portion of one leg through which a horizontal stack section of the exhaust stack extends.

A method of at least partially supporting an exhaust stack according to one disclosed non-limiting embodiment of the present disclosure includes assembling a first lattice section, the first lattice section comprises a first leg, a second leg, and a third leg forming a triangular shaped first lattice section of a tower, the first, second and third leg each constructed of a solid galvanized steel rod, the first lattice section comprises a multiple of stack supports that are movably mounted to each of the first, second and third legs; assembling the first lattice section at least partially around a vertical stack section of the exhaust stack; positioning each of the multiple of stack supports along the respective leg; and welding each of the multiple of stack supports to the respective leg and to the vertical stack section of the exhaust stack.

A further embodiment of any of the foregoing embodiments of the present disclosure includes that positioning each of the multiple of stack supports along the respective leg comprises sliding and rotating the respective stack support along the respective leg to a desired position prior to welding.

A further embodiment of any of the foregoing embodiments of the present disclosure includes that positioning each of the multiple of stack supports along the respective leg comprises sliding the respective stack support along the respective leg between a first horizontal and a second horizontal.

A further embodiment of any of the foregoing embodiments of the present disclosure includes that positioning each of the multiple of stack supports along the respective leg comprises sliding the respective stack support along the respective leg between a first diagonal and a second diagonal.

A further embodiment of any of the foregoing embodiments of the present disclosure includes that the multiple of stack supports are movably mounted to each of the first, second and third legs via an annular portion around one of the respective legs.

The foregoing features and elements may be combined in various combinations without exclusivity, unless expressly indicated otherwise. These features and elements as well as the operation thereof will become more apparent in light of the following description and the accompanying drawings. It should be appreciated that however the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows:

FIG. 6 is a side view of a base flange assembly according to a disclosed non-limiting embodiment.

FIG. 7 is a top view of the base flange assembly of FIG. 6.

DETAILED DESCRIPTION

Figure 1:
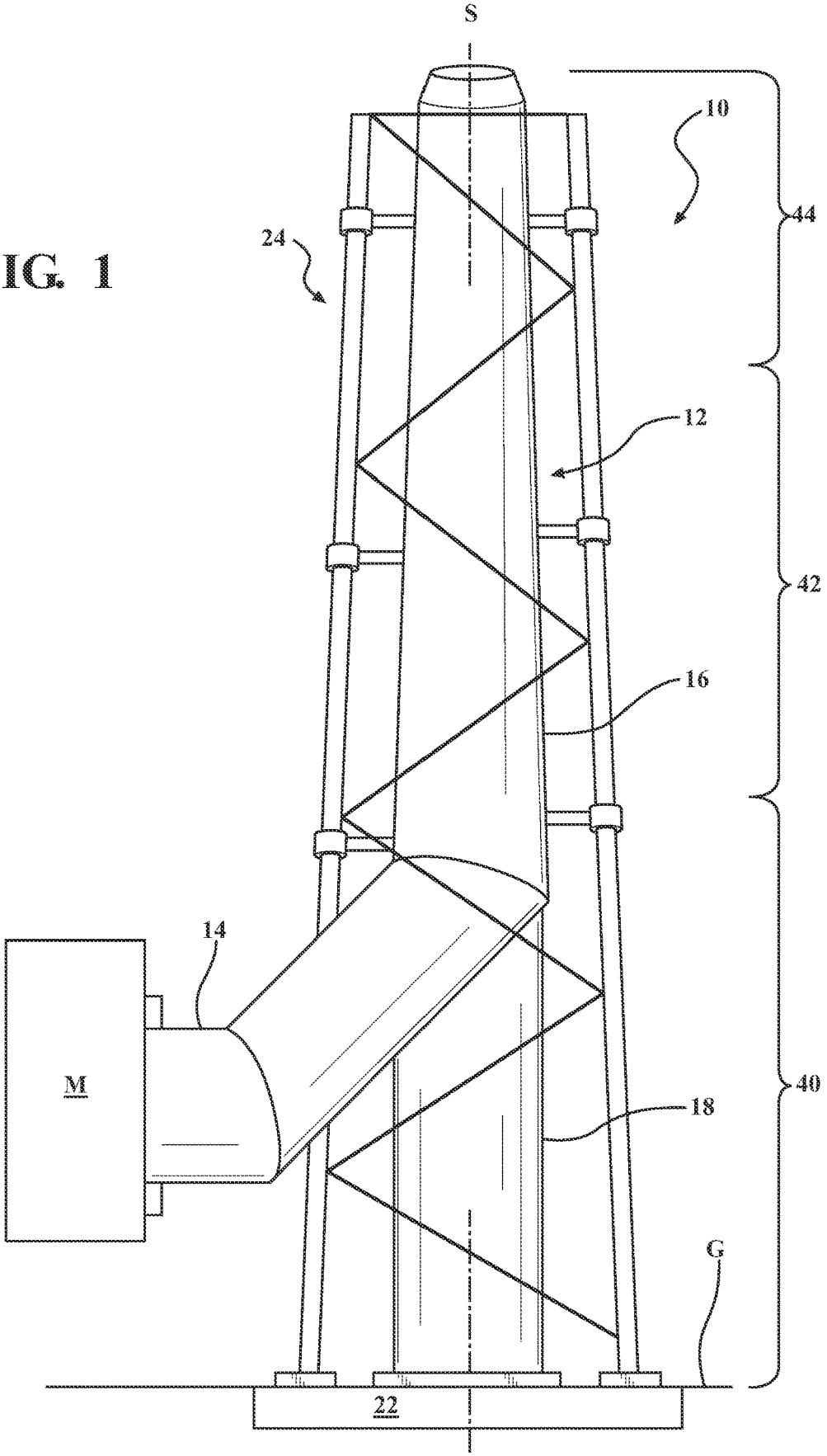
FIG. 1 is a perspective side view of a lattice tower structure according to one disclosed non-limiting embodiment.

FIG. 1 schematically illustrates a lattice tower structure 10 that is utilized to at least partially support an exhaust stack 12. In one example, the exhaust stack 12 may include, with respect to the ground G, a generally horizontal stack section 14 and a generally vertical stack section 16 connected thereto. The generally horizontal stack section 14 may be connected to machinery M within a structure. The generally vertical stack section 16 may be defined along an axis S.

A structure 18 positioned between the ground G and the generally vertical stack section 16. The structure 18, in one embodiment may be arranged along axis S and be of various configurations.

Figure 2:
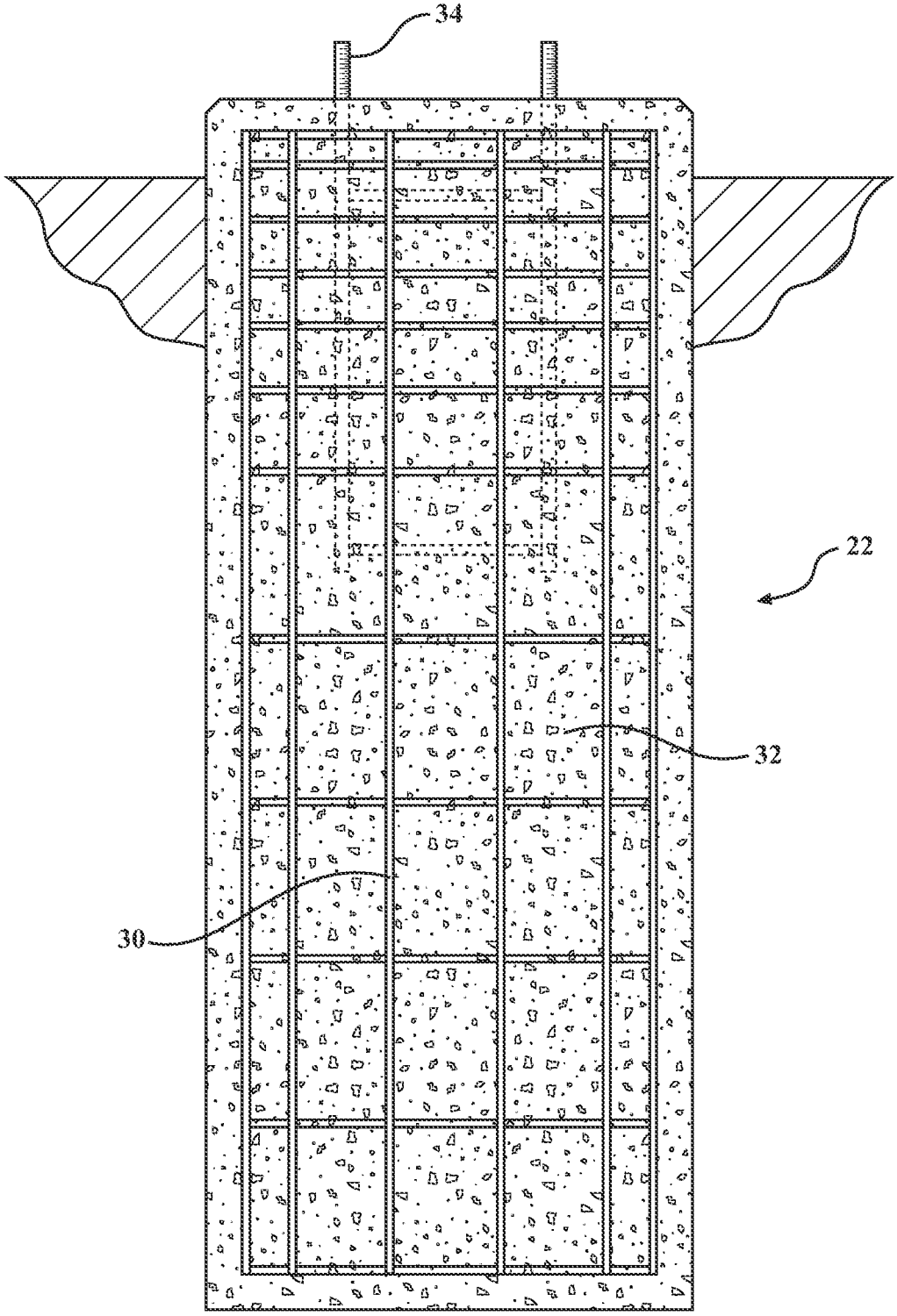
FIG. 2 is a sectional view of a pier for the lattice tower structure according to a disclosed non-limiting embodiment.

The lattice tower structure 10 may include a pier 22 (also shown in FIG. 2) that is located in the ground G to support a lattice tower 24. The pier 22 may be manufactured primarily of a non-metallic concrete material while the lattice tower 24 is manufactured primarily of metallic materials. In one embodiment, the pier 22 generally includes a rebar support structure 30 that reinforces the concrete material 32 to stabilize and support a cluster of three anchor base bolts 34 (FIG. 2). In one example, the concrete material 32 may be 4000 PSI minimum compressive strength concrete while the cluster of three anchor base bolts 34 may include 4 foot long, 1 inch diameter bolts.

Figure 3:
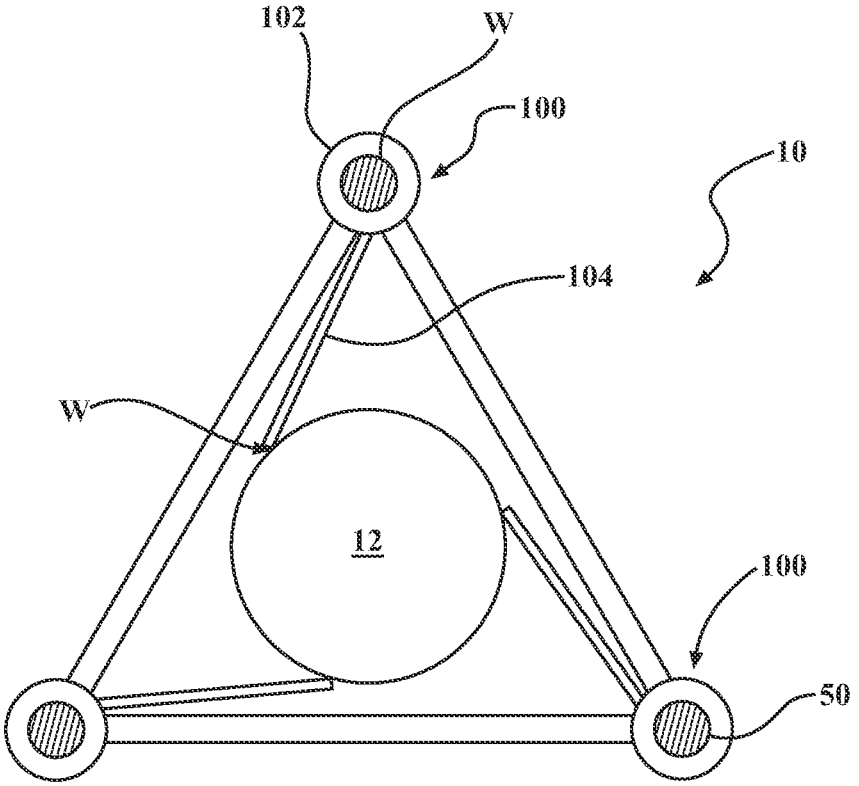
FIG. 3 is an expanded sectional view of a lattice tower structure section around an exhaust stack according to a disclosed non-limiting embodiment.

The lattice tower 24 may be assembled from a multiple of sections such as a first lattice section 40, a second lattice section 42, and a third lattice section 44. It should be appreciated that any number of sections may benefit herefrom. In one embodiment, each of the lattice sections 40, 42, 44 may be manufactured of an all galvanized steel, all welded construction utilizing 1018 minimum strength 1-inch diameter SR solid rod hot dipped galvanized steel legs 50 with 1018 minimum strength 0.5-inch diameter SR solid rod hot dipped galvanized steel diagonals 52 and horizontals 54. The legs 50, diagonals 52 and horizontals 54 may be solid steel rod. In one embodiment, the legs 50 are arranged in a triangular pattern at least partially around the exhaust stack 12 (FIG. 3).

Figure 4:
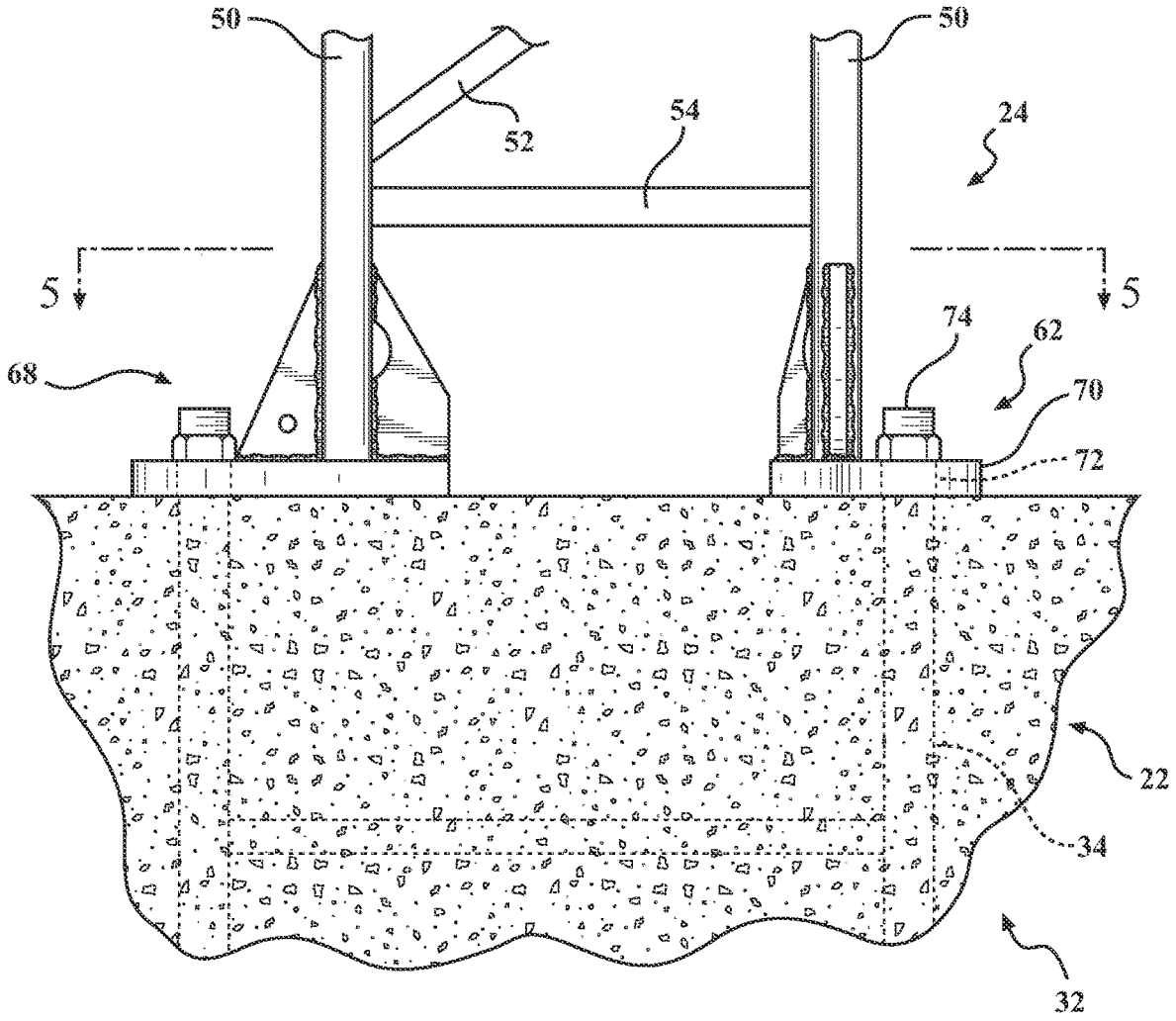
FIG. 4 is an expanded sectional view of the lattice tower structure pier attachment according to a disclosed non-limiting embodiment.

With reference to FIG. 4, the lattice tower 24 may be fastened to the pier 22 via a base assembly 68 that receives the three anchor base bolts 34. The base assembly 68 of the first lattice section 40 includes a base flange assembly 62 on each of the three legs 50. Each base flange assembly 62 includes a foot 70 with an aperture 72 to receive the anchor base bolts 34 which is then retained with a nut 74.

Figure 5:
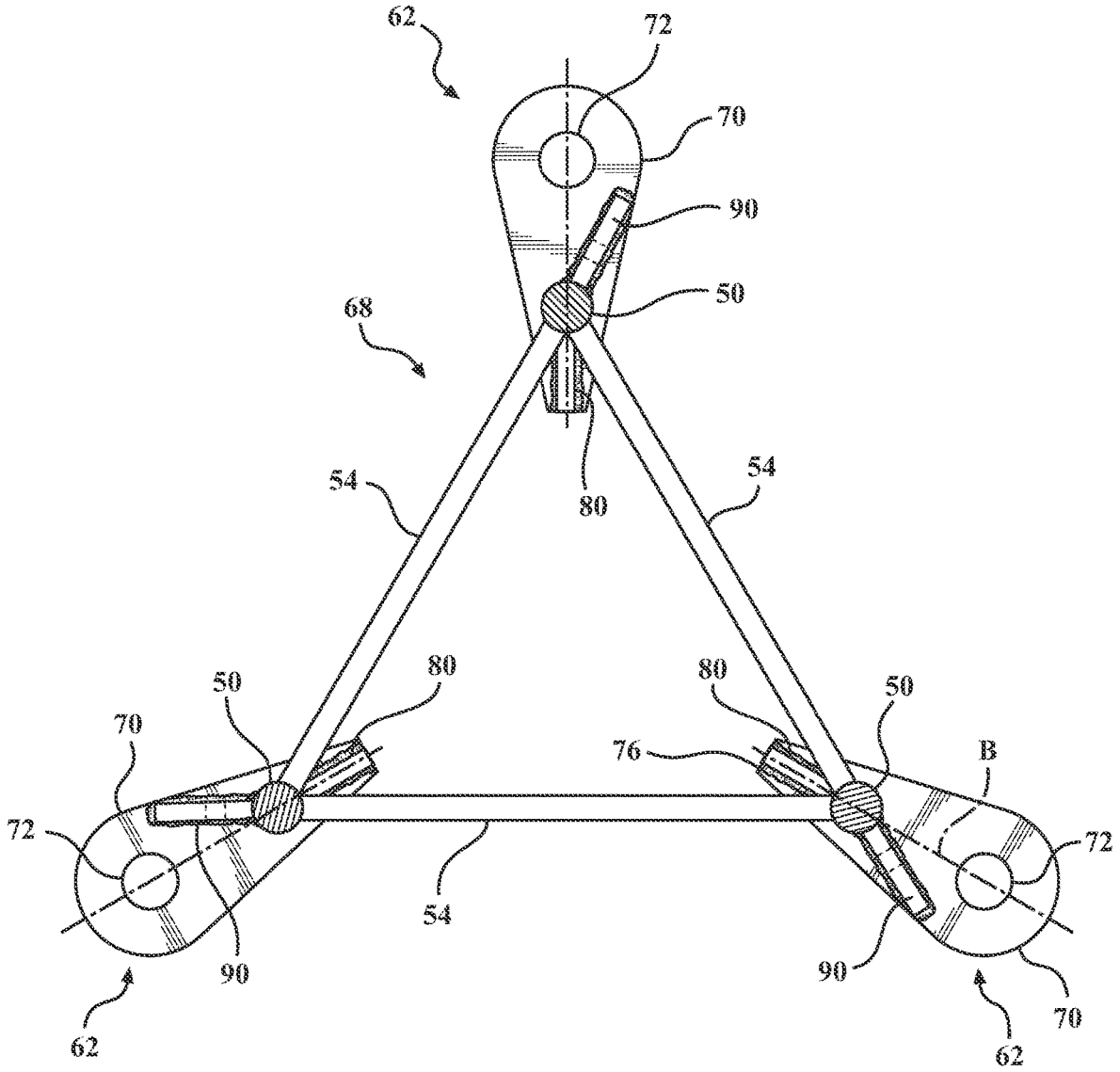
FIG. 5 is a top view of a lattice tower section.

With reference to FIG. 5, each base flange assembly 62 includes an inner gusset 80 and an outer gusset 90 that are both welded to the foot 70 and the respective leg 50 (FIG. 6). The inner gusset 80 includes a notch 84 that permits welding of the horizontals 54 to the leg 50. The inner gusset 80 is located between the two horizontals 54 that are welded to the leg 50 and extend to an inner edge 76 of the foot 70. In one example, the inner gusset 80 extends 1.625 inches from the leg 50 to the inner edge 76 of the foot 70 along an axis B that is defined between the centers of the aperture 72 and the leg 50.

The outer gusset 90 extends outward toward the aperture 72. The outer gusset 90 in this embodiment defines an angle with respect to axis B of 28 degrees (FIG. 7). In one example, the outer gusset 90 extends 2.0 inches to an outer edge 78 of the foot. The outer gusset 90 essentially extends the horizontals 54 to provide a further interface with the foot 70.

A multiple of stack supports 100 extend from the legs 50 to engage the generally vertical stack section 16 of the exhaust stack 12. In one embodiment, each of the multiple of stack supports 100 utilizing 1018 minimum strength 1-inch diameter SR solid rod hot dipped galvanized steel. Although a particular geometry for the stack supports 100 is disclosed in the illustrated embodiment, various other geometries, lengths, diameters, etc., may alternatively or additionally be provided that secures the legs 50 to engage the generally vertical stack section 16. In one embodiment, the stack supports 100 facilitate welding.

Figure 8:
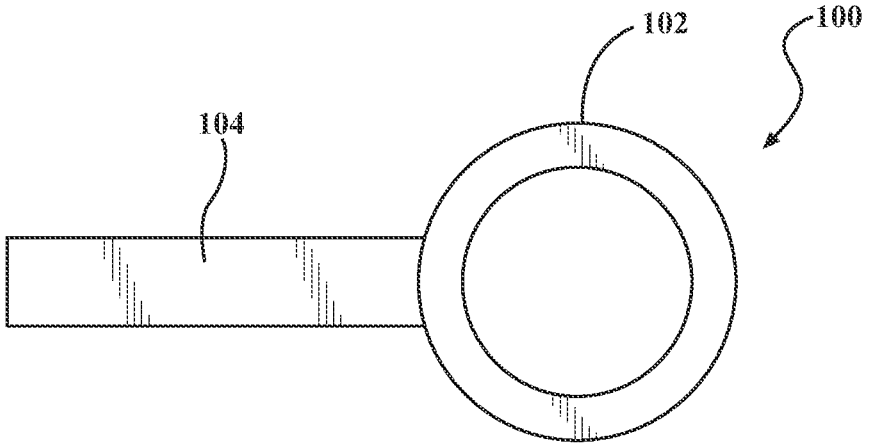
FIG. 8 is a top view of a stack supports according to one disclosed non-limiting embodiment.
Figure 9:
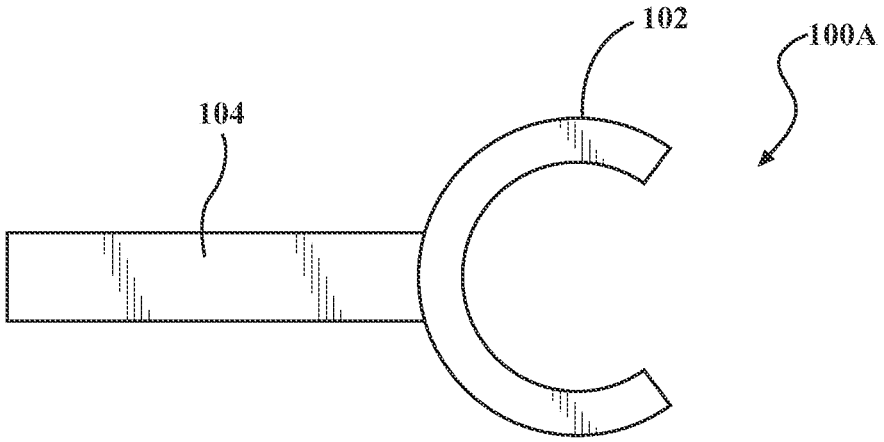
FIG. 9 is a top view of a stack supports according to another disclosed non-limiting embodiment.

With reference back to FIG. 3, in one embodiment, each of the multiple of stack supports 100 may include an annular portion 102 and an attachment portion 104. The annular portion 102 may be positionable around one of the respective legs 50 and is welded at W thereto. The annular portion 102 may be completely annular (FIG. 8) or semi-annular (FIG. 9) to fit around the leg 50. In one embodiment, the annular portion 102 may be pre-assembled around the leg 50 between particular steel diagonals 52 and horizontals 54 then vertically and rotationally positioned as required during assembly around the exhaust stack 12 (FIG. 11) then welded to the leg 50 upon assembly of the lattice tower 24 to the exhaust stack 12. The attachment portion 104 is then welded to the exhaust stack 12. In other words, the lattice tower 24 may be assembled around a preexisting exhaust stack 12 prior to, for example, disconnection of the generally horizontal section 14 from the machinery M in response to an expected repair, maintenance, etc.

Figure 10:
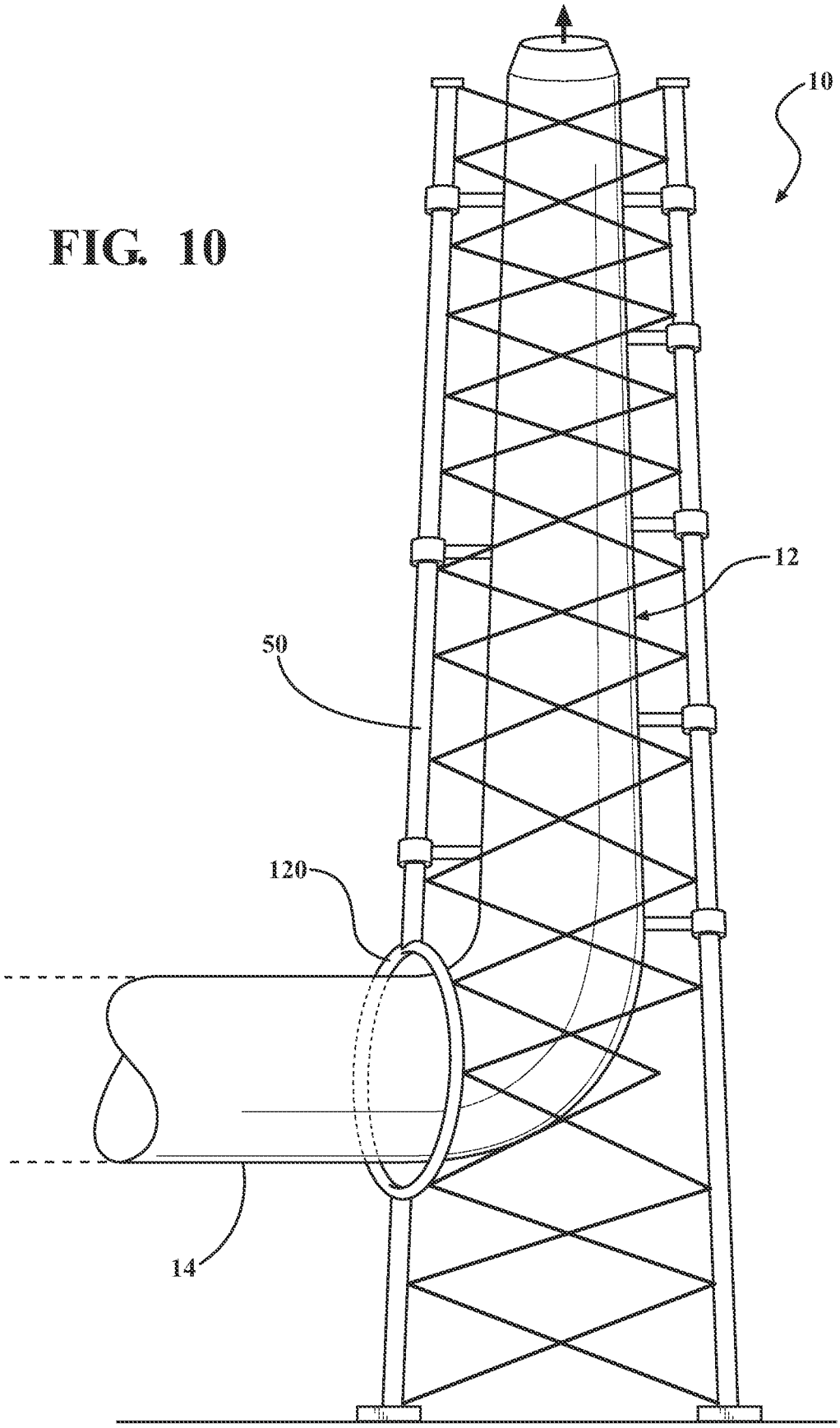
FIG. 10 is a perspective side view of a lattice tower structure according to another disclosed non-limiting embodiment.

With respect to FIG. 10, in another embodiment, an annular support 120 may be formed in one of the legs 50 to at least partially support the horizontal stack section 14. That is, a portion of one leg forms the annular support through which the horizontal stack section 14 of the exhaust stack 12 may extend.

Figure 11:
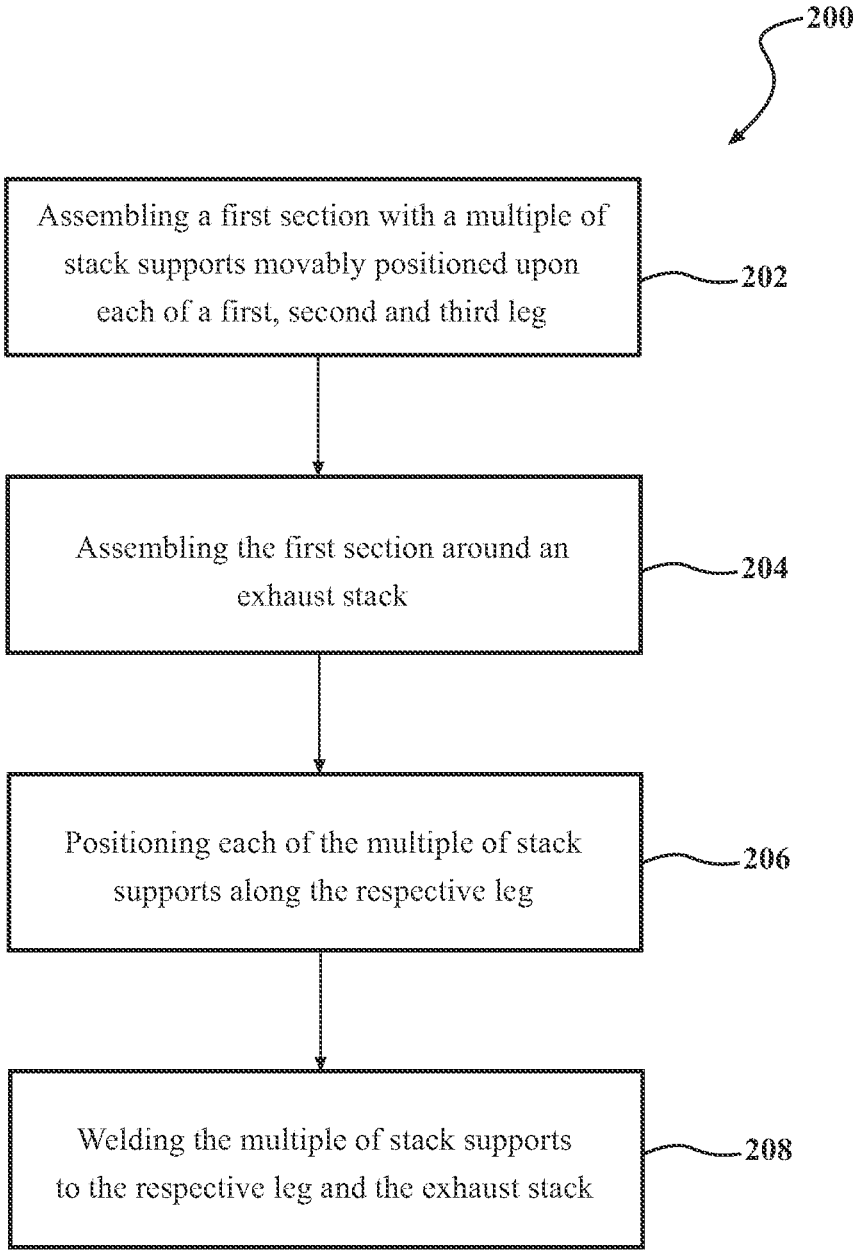
FIG. 11 is a block diagram illustrating assembly of the lattice tower structure around an exhaust stack according to one disclosed non-limiting embodiment.

With respect to FIG. 11, a method 200 of at least partially supporting the exhaust stack with the lattice tower 24 initially includes at least partially assembling the first lattice section 40 (202). The first lattice section 40 may include the legs 50, diagonals 52 and horizontals 54 as described. The multiple of stack supports 100 are assembled to each of the legs 50 via the annular portion 102. That is, the annular portion 102 may be slid onto the respective leg 50 such that each stack support 100 is trapped between respective diagonals 52 and/or horizontals 54 along the length of the first lattice section 40. That is, various initial assembly of the first lattice section may be assembled offsite.

Next, the first lattice section 40 may be assembled at least partially around a vertical stack section 16 of the exhaust stack 12 (204). That is, various portions of the first lattice section 40 may be assembled around the exhaust stack subsequent to subassembly offsite.

Next, each of the multiple of stack supports 100 may be positioned (206) along the respective leg. That is, the multiple of stack supports 100 may be vertically and rotationally positioned along the respective leg 50 with respect to the exhaust stack. As each stack support 100 is trapped between respective diagonals 52 and/or horizontals 54 along the length of the first lattice section 40, the proper number and general position of the multiple of stack supports 100 are prepositioned for later welding.

Finally, each of the multiple of stack supports 100 are welded (208) to the respective leg 50 and to the vertical stack section 16 of the exhaust stack 12.

The lattice tower 24 with positionable stack supports 100 readily facilities on-site assembly and support of various shaped exhaust stacks.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A lattice tower structure, comprising:

a first lattice section that comprises a first leg, a second leg, and a third leg forming a triangular shaped first lattice section of the tower, the first, second and third leg each constructed of a solid galvanized steel rod;

an exhaust stack at least partially secured within the first, second and third leg; and an annular support formed as a portion of one leg through which a horizontal stack section of the exhaust stack extends.

2. The tower as recited in claim 1, further comprising a multiple of stack supports that extend from each of the first, second and third legs to engage a vertical stack section of the exhaust stack.

3. The tower as recited in claim 2, wherein each of the multiple of stack supports comprise an annular portion and an attachment portion, the annular portion mounted around one of the respective legs and the attachment portion attached to the vertical stack section of the exhaust stack, the annular portion welded to the respective leg.

4. The tower as recited in claim 2, wherein at least one of the multiple of stack supports is located between each of a first horizontal and a second horizontal between at least two of the first, second and third legs.

5. The tower as recited in claim 2, further comprising a multiple of horizontals between at least two of the first, second and third legs, at least one of the multiple of stack supports located between each pair of the multiple of horizontals.

6. The tower as recited in claim 2, wherein at least one of the multiple of stack supports is located between each of a first diagonal and a second diagonal between at least two of the first, second and third legs.

7. The tower as recited in claim 2, further comprising a multiple of diagonals between at least two of the first, second and third legs, at least one of the multiple of stack supports located between each pair of the multiple of diagonals.

8. The tower as recited in claim 1, further comprising:

a foot welded to each leg of the lattice section, each foot having an aperture;

an inner gusset welded to each foot and the respective leg, the inner gusset extends toward an inner edge of the respective foot; and an outer gusset welded to each foot, the outer gusset extends toward the aperture of the respective foot.

9. The tower as recited in claim 8, wherein each outer gusset defines an angle with respect to an axis defined between a center of the aperture and a center of the respective leg.

10. The tower as recited in claim 9, wherein the outer gusset extends outward toward the aperture.

11. The tower as recited in claim 10, wherein the outer gusset defines the angle.

12. The tower as recited in claim 10, wherein the outer gusset defines the angle with respect to the axis.

13. The tower as recited in claim 12, wherein the angle is 28 degrees.

14. The tower as recited in claim 13, wherein the outer gusset extends for a length greater than the inner gusset with respect to the leg.

* * * * *